US007404726B1

(12) United States Patent
Herring et al.

(10) Patent No.: US 7,404,726 B1
(45) Date of Patent: Jul. 29, 2008

(54) APPARATUS AND METHOD FOR FLOATING CONNECTOR CAPTURE

(75) Inventors: Dean Frederick Herring, Youngsville, NC (US); William Lewis Talley, Wake Forest, NC (US); Danny Hugh Addison, Durham, NC (US); Robert J. Heider, Durham, NC (US)

(73) Assignee: International Business Machines Corporation (IBM), Armonk, NY (US)

( * ) Notice: Subject to any disclaimer, the term of this patent is extended or adjusted under 35 U.S.C. 154(b) by 0 days.

(21) Appl. No.: 12/024,004

(22) Filed: Jan. 31, 2008

(51) Int. Cl.
*H01R 13/64* (2006.01)

(52) U.S. Cl. ..... 439/246; 439/247; 439/248

(58) Field of Classification Search ..... 439/246–248
See application file for complete search history.

(56) References Cited

U.S. PATENT DOCUMENTS

| | | | | |
|---|---|---|---|---|
| 4,934,943 | A * | 6/1990 | Klein et al. | 439/65 |
| 5,328,381 | A | 7/1994 | Seymour et al. | |
| 5,605,150 | A | 2/1997 | Radons et al. | |
| 6,030,242 | A * | 2/2000 | Cunningham et al. | 439/247 |
| 6,155,858 | A | 12/2000 | Ozawa et al. | |
| 6,767,220 | B2 | 7/2004 | Wilson et al. | |
| 7,059,882 | B2 * | 6/2006 | Sugita et al. | 439/247 |
| 7,083,453 | B2 | 8/2006 | Herring et al. | |
| 2002/0177340 | A1 * | 11/2002 | Carrodus et al. | 439/247 |
| 2005/0032406 | A1 | 2/2005 | Shiota et al. | |

* cited by examiner

*Primary Examiner*—Tho D Ta
(74) *Attorney, Agent, or Firm*—Maxvalueip, LLC

(57) ABSTRACT

An apparatus is disclosed that surrounds a connector and places it within the printer body in such away as to allow for the connector to float against the intrusion of a sliding can mounted with electronics and to set up and enable the printer. The problem solved is that of the blind-mating connectors within a printer system for which an industry standard connector set for flex cable must be used. It is advantageous to allow a connector that is attached to a flex cable to float even though the floating feature has not been considered in the original design and the connector was not made for the amount of misalignment present in a blind-mate connection. In addition, by a single-rib design, an extra degree of freedom for rotational around Y-axis is provided to the floating connector to further guide the lead-in of the contacting face of the mating connector.

1 Claim, 6 Drawing Sheets

APPARATUS AND METHOD FOR FLOATING CONNECTOR CAPTURE

BACKGROUND OF THE INVENTION

Proper mechanical mating and electrical connection are two features crucial both to implement the application and to protect the equipment from accidental damage due to loose connection. To this end, various designs have been proposed in the past. One of the main common problems in connecting the cables in any computer or electrical hardware is the issue of misalignment. If the pins and holes, for instance, are not perfectly aligned, a proper connection is almost impossible and might lead to damage to the connectors or other hardware. While they might be possible in theory, perfectly aligned connectors are either not manufacturable or their manufacture is associated with high costs. On the other hand, perfectly aligning the pins and holes manually is a tedious and time-taking task. It is highly advantageous to implement a connector system that has some controlled degree of freedom to allow the receiving connector to shift or rotate to facilitate a proper lead-in and a successful electrical connection.

SUMMARY OF THE INVENTION

An apparatus is disclosed that surrounds the connector mentioned above and places it within the printer body in such away as to allow for the connector to float against the intrusion of a sliding can mounted with electronics and to set up and enable the printer. The problem solved is that of the blind mating connectors within a printer system for which an industry standard connector set for flex cable must be used. It is advantageous to allow a connector that is attached to a flex cable to float even though the floating feature has not been considered in the original design, especially when the connector was not made for the amount of misalignment that is seen in a blind mate connection. By a one-rib design, an extra degree of rotational freedom around a Y-axis is given to now "floating connector" to further guide the lead-in of the second contacting face inside the mating connector.

DETAILED DESCRIPTION OF THE PREFERRED EMBODIMENTS

An embodiment of the invention discloses an apparatus that surrounds the connector (110 or 202) and places it within the printer base (120, 324, 424, 524, or 624) in such away as to allow for the connector (110) to float at the time of intrusion of a sliding can (130) with electronics on it to facilitate such connection in case of slight misalignment. This implements the printer connection and enables it.

Figure 1:
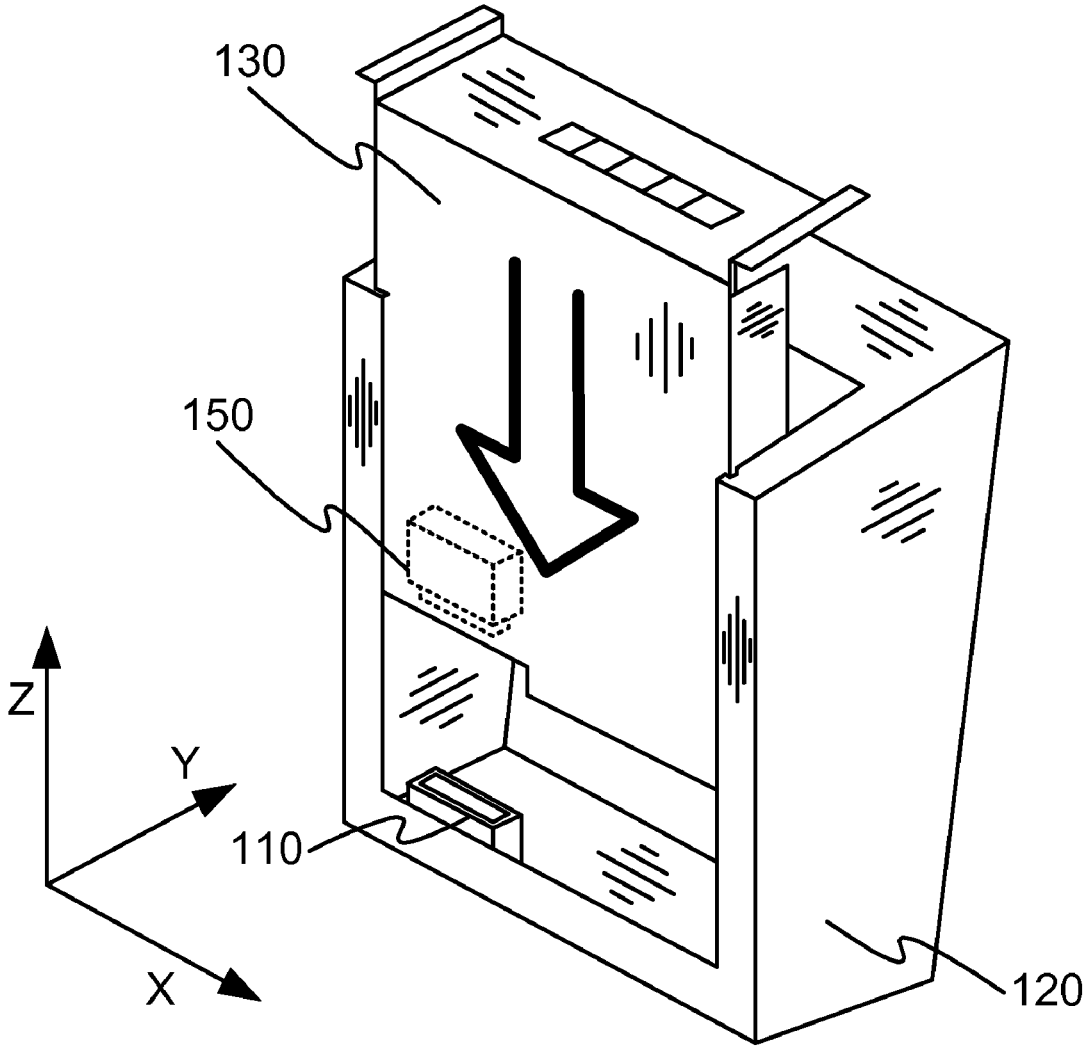
FIG. 1 shows the intrusion of the sliding can into the printer base and the floating connector.
Figure 2:
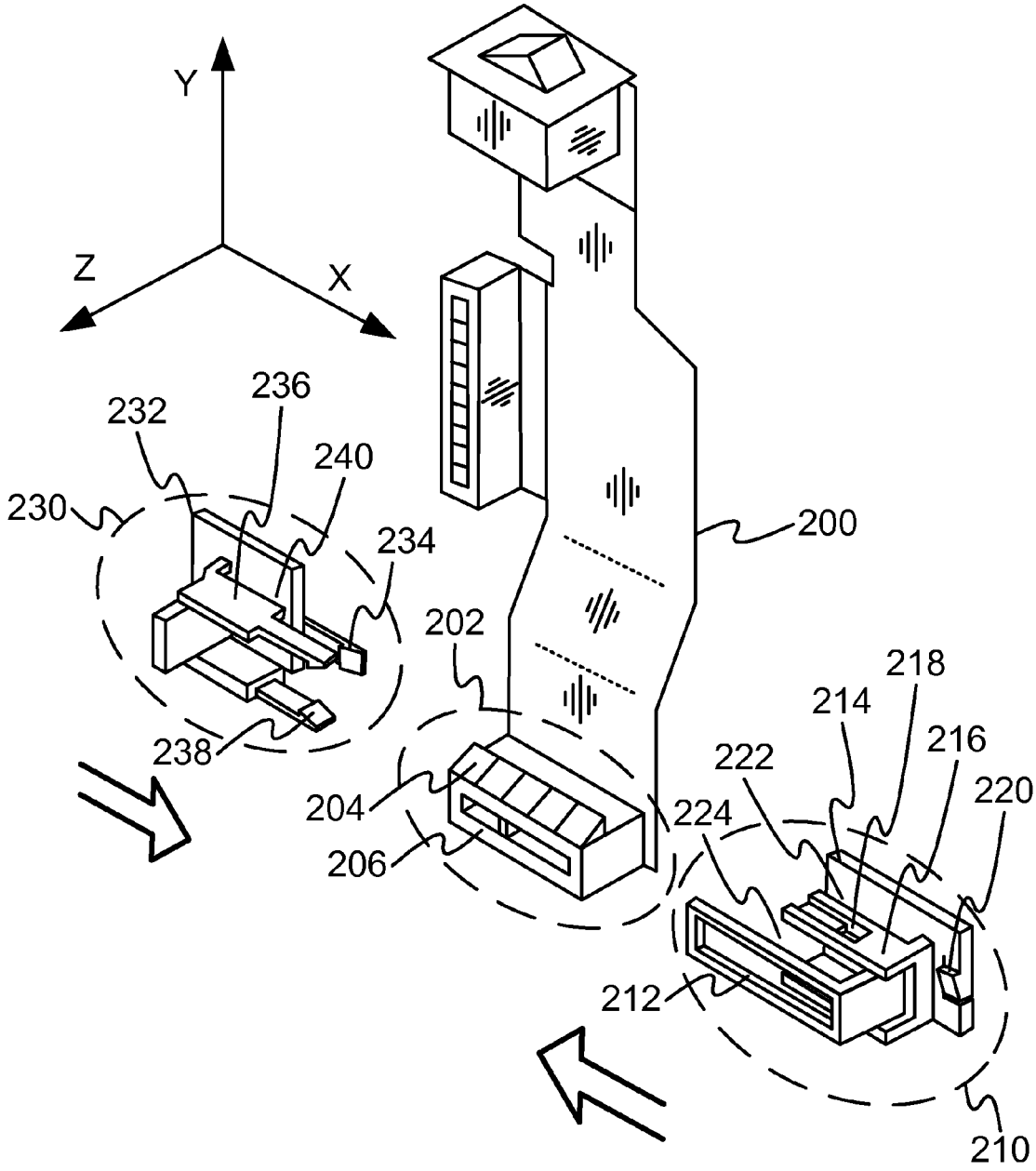
FIG. 2 shows the parts and forming of the connector capture portion.
Figure 3:
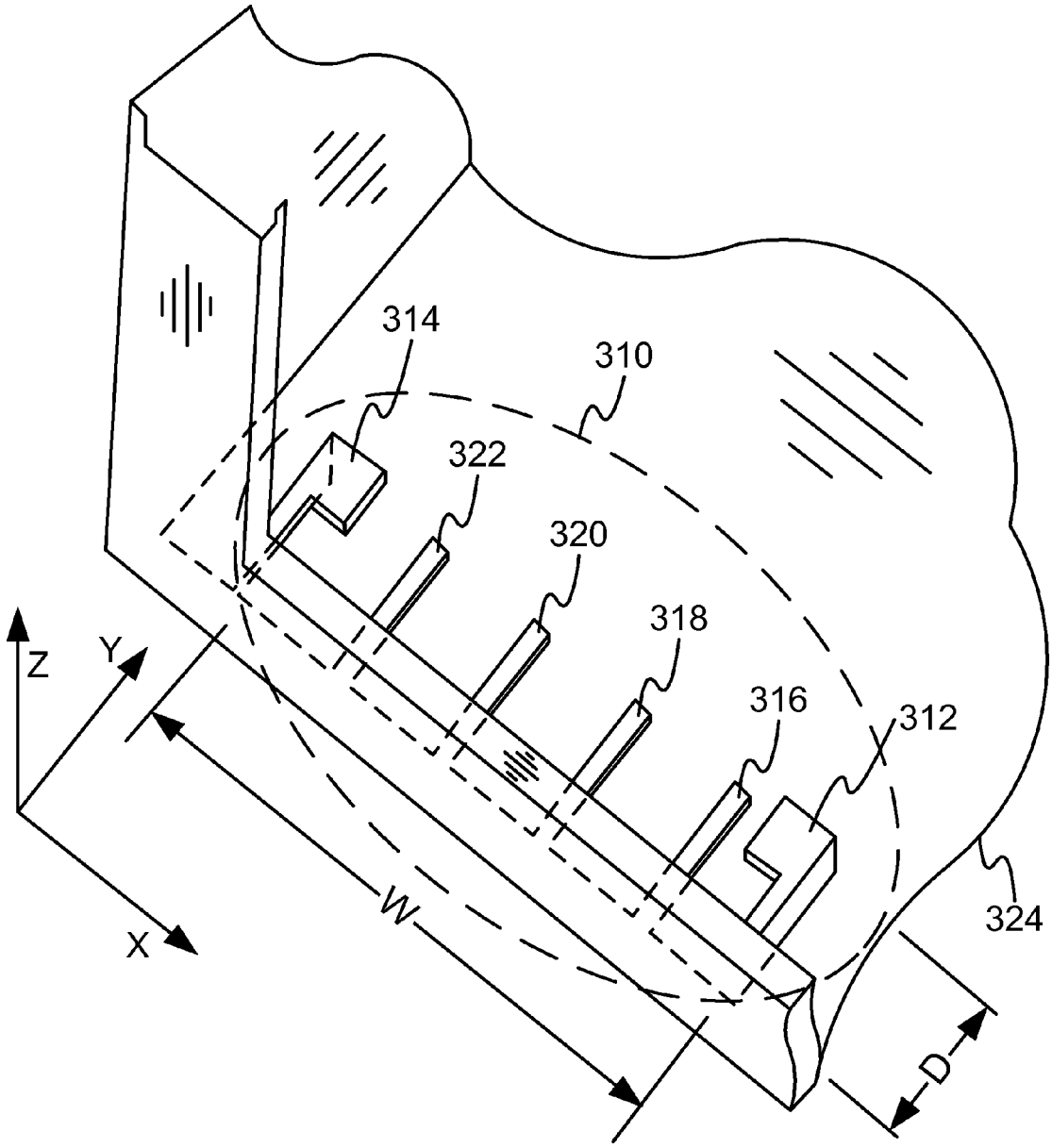
FIG. 3 shows the base housing receptacle along with its width and depth.
Figure 4:
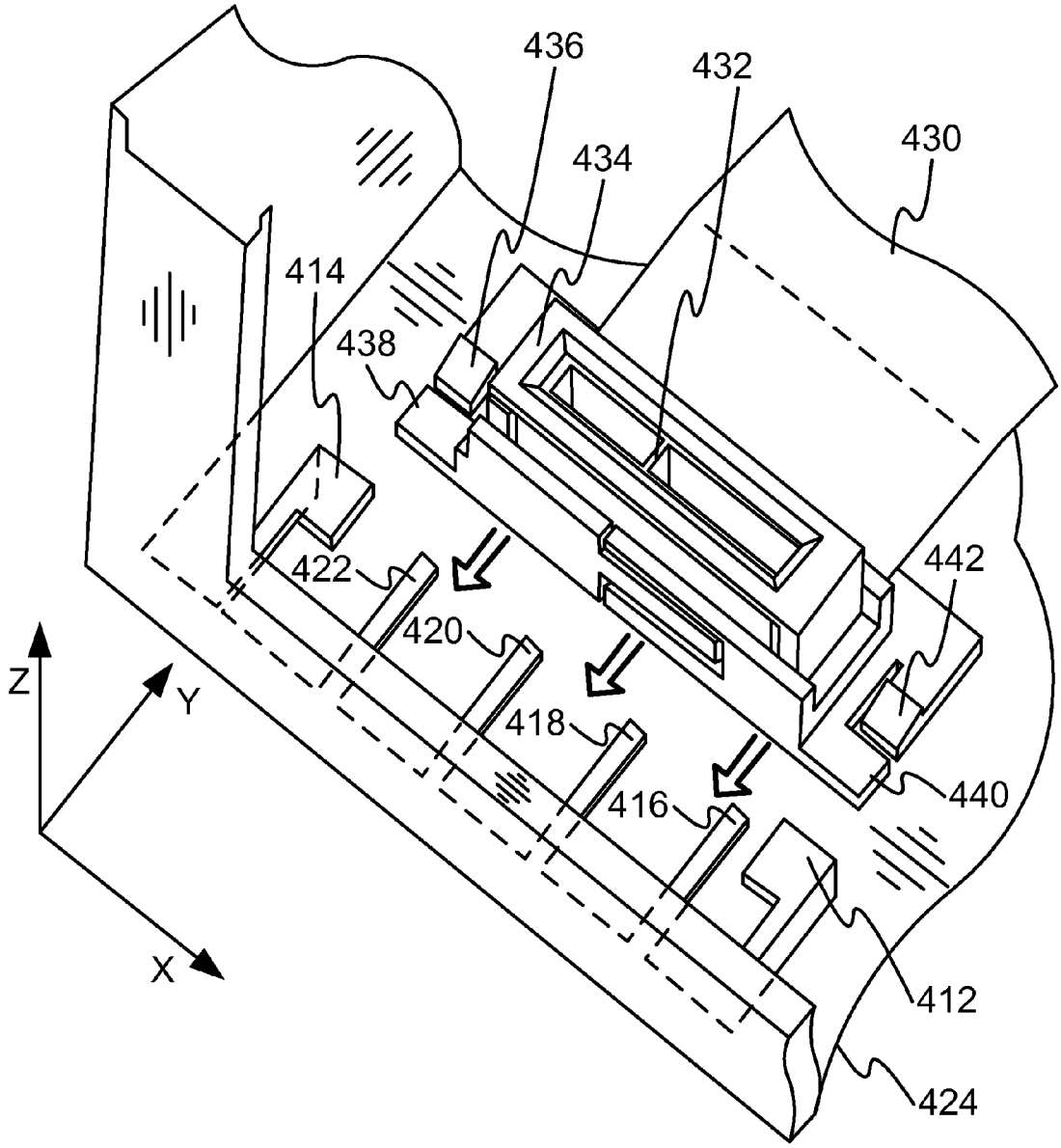
FIG. 4 illustrates the sliding and mounting of the connector capture portion into the base housing receptacle.

This embodiment works by encapsulating a connector (202) that is attached to a flex circuit board cable (200, 430, or 530) with a two piece snap-together design (210 and 230). One of the two pieces (210) has an extra face (212, 434, 534, or 634) upon which additional connector lead-in features are located (e.g., sloped guiding edges at the opening of the face) so as to guide the blind-mating of the floating connector (110 or 202) in the base (120) together with the mating connector (150) in the can (130). In one embodiment (FIG. 4), the captured connector is then mated with the base (424) in such a way as to be restrained within a tolerance zone of the mating connectors in x and y directions with the ability to move in those directions whilst also offering rotation about z axis. In FIG. 3, the depth (D) and width (W) of the base housing receptacle is slightly larger than the dimensions of sliding portion of the connector capture assembly (436, 438, 449, and 442) to allow for a clearance in the lateral x and y directions. The mentioned clearances allows for two degrees of translational freedom and one degree of rotational freedom for the captured connector to facilitate the lead-in.

Figure 5:
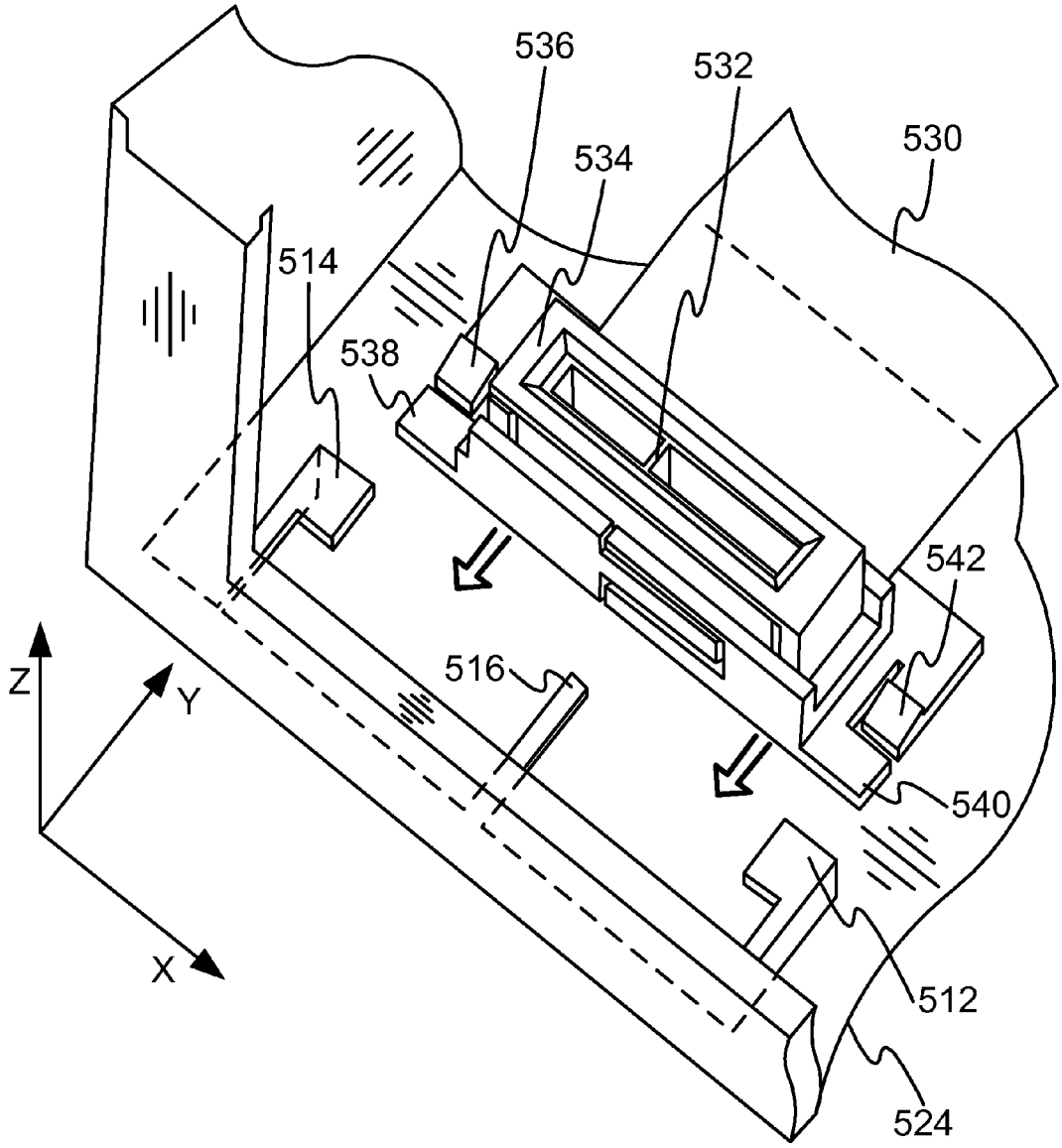
FIG. 5 illustrates the sliding and mounting of the connector capture portion into the base housing receptacle with a one-rib design.
Figure 6:
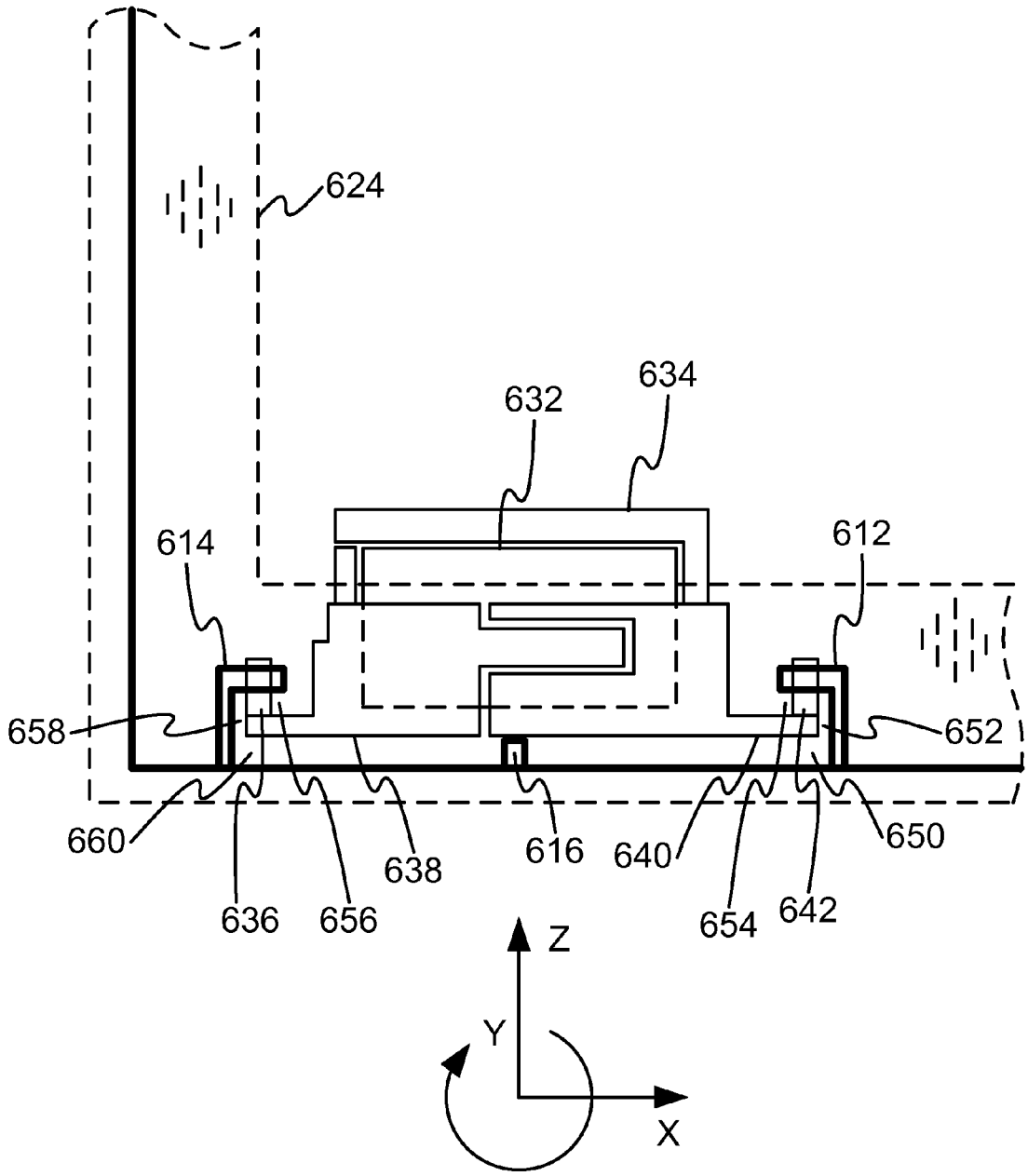
FIG. 6 shows the side-view of the connector capture portion with the one-rib design mounted in the base housing receptacle, and illustrates the slight rotational freedom this design grants.

In another embodiment (FIGS. 5 and 6), the number of degrees of freedom for the captured connector is increased by using a one-rib (516, 616) design, which provides the captured connector additional degree of freedom for rotating around Y-axis to further ease the aligning process at the time of lead-in.

An embodiment of this invention comprises (1) blind mate floating connector apparatus for flex circuit connector with (2) additional lead-in above and beyond the standard connector, (3) two piece snap around (connector) snap together, (4) two linear direction float with additional rotation about two axes, and (5) snap in place tool-less to base housing.

In several embodiments of the present invention as illustrated in FIGS. 1-6, an apparatus is presented for blind-mating a floating connector (110, 202) with a mating connector within a printer system. The apparatus comprises a connector capture portion (comprising 210 and 230 assembly) and a base housing receptacle (310). The floating connector (202) is attached to a flex cable (200, 430, or 530). The floating connector (202) has a connector protrusion (204) and a first contacting face (206, 432, 532, or 632). The flex cable (200) is attached to a base portion (120, 324, 424, 524, or 624) of the printer system. The mating connector (150) is attached to a can portion (130) of the printer system. The mating connector (150) has a second contacting face. The blind-mating is done by sliding the can portion (130) of the printer system onto the base portion (120) of the printer system so that the second contacting face of the mating connector contacts the first contacting face (206, 432, 532 or 632) of the floating connector (110 or 202). The connector capture portion (210 and 230 assembly) comprises of a first capture part (210) and a second capture part (230).

The first capture part (210) comprises a front lead-in alignment guide (212, 434, 534, or 634), a first back support portion (214, 440, 540 or 640) having a back support groove, a first plurality of sides (e.g., 216), wherein each of the first plurality of sides has a side groove (e.g., 218), and a first sliding snap (220, 442, 542, or 642).

The first capture part has a first cable gap (222) between the first back support portion (214) and the first plurality of sides (e.g., 216). It has a connector gap (224) between the front lead-in alignment guide (212, 434, 534, or 634) and the first plurality of sides (216). The second capture part (230) comprises a second back support portion (232, 438, 538, or 638) having a back support snap (234), a second plurality of sides (e.g., 236), wherein each of the second plurality of sides has a side snap (e.g., 238), and a second sliding snap (436, 536, or 636). The second capture part (230) has a second cable gap (240) between the second back support portion (232) and the second plurality of sides (236). The first capture part (210) and the second capture part (230) snap together to encapsulate the floating connector (110, 202).

In this encapsulation, the back support snap (234) fits in the back support groove (on 210), each side snap (e.g., 238) of each of the second plurality of sides (e.g., 236) fits in the corresponding side groove (e.g., 218) of the first plurality of sides (e.g., 216). The first cable gap (222) and the second cable gap (240) align to fit the flex cable (200, 430, or 530) through the connector capture portion (210 and 230 assembly). The first back support portion (214) and the second back support portion (232) align to support the floating connector (202) within the connector capture portion (210 and 230 assembly). The connector protrusion (204) fits in the connector gap (224) through the connector capture portion (210 and 230 assembly). The front lead-in alignment guide (212, 434, 534, or 634) aligns above and beyond the first contacting face (206, 432, 532 or 632) of the floating connector (202), exposing the first contacting face through the connector capture portion (210 and 230 assembly), and the connector capture portion (210 and 230 assembly) securely encapsulates the floating connector (202).

The base housing receptacle (e.g. 310) is attached to the base portion of the printer system (e.g. 324). In one embodiment, the base housing receptacle comprises one rib (516 or 616), a first base mating element (512 or 612) a the second base mating element (514 or 614) with the rib positioned between the first and second mating elements. In another embodiment, the base housing receptacle comprises multiple ribs (e.g., 416, 418, 420, 422, 316, 318, 320, or 322), the first base mating element (312, 412, 512, or 612), and the second base mating element (314, 414, 514, or 514). In an embodiment of the invention, on or more ribs and the first and second base mating elements provide a cavity within the base housing receptacle (310).

In one embodiment, a sliding portion of the connector capture portion (210 and 230 assembly) comprises a first front portion of the first back support portion (440, 540, or 640), a second front portion (438, 538, or 638) of the second back support portion, the first sliding snap (442, 542, or 642), and the second sliding snap (436, 536, or 538). The dimensions of the cavity are larger than corresponding dimensions of the sliding portion so that the sliding portion loosely fits within the cavity by sliding the connector capture portion (210 and 230 assembly) onto the base housing receptacle (310) along and over one or more ribs (as illustrated by arrows in FIGS. 4 and 5).

In one embodiment, the first back support portion and the second back support portion are located above a rib (e.g., 616), the first sliding snap fits in the first base mating element, and the second sliding snap fits in the second base mating element, to hold the sliding portion within the cavity of the base housing receptacle (310).

In one embodiment, at the blind-mating, the base housing receptacle (e.g., a collection of 512, 514 and 516) provides a rotational tolerance zone around Y axis (FIGS. 5-6) for the connector capture portion within the cavity (between 614, 612, and 616) by having the connector capture portion pivot along and over a rib (516 or 616) so that the first contacting face (532 or 632) becomes parallel to the second contacting face of the mating connector (150).

In one embodiment, at the blind-mating, the base housing receptacle (310) provides a planar tolerance zone (e.g., FIG. 3, in X-Y plane) within the cavity for both lateral movements and rotation (e.g., about Z axis) for the connector capture portion (210 and 230 assembly) within a plane parallel to the second contacting face of the mating connector (150).

In one embodiment, at the blind-mating, if the first contacting face (532 or 632) of the floating connector (202) and the second contacting face of the mating connector (150) are misaligned prior to the blind-mating, then the front lead-in alignment guide (534) is moved by the mating connector to position the connector capture portion (210 and 230 assembly) within the rotational tolerance zone around Y axis (FIG. 6) and the planar tolerance zone so that the first contacting face (532 or 632) and the second contacting face come to alignment for contact while the sliding portion of the connector capture portion (210 and 230 assembly) is held within the base housing receptacle.

The clearances created by the application of one embodiment facilitate lead-in of the mating connector (150). The clearances help lateral movement in X-direction (658, 652) and Y-direction, around Y-axis (650, 654, 656, and 660), and around Z-direction as described previously.

The discussed embodiments are in no way intended to limit similar applications of this invention to other areas such as displays, other designs of printers or I/O technologies, mechanical and electrical assemblies, other blind-mate connector systems, electronics industry for blind-mating of connector on flex circuits, blind docking of electronic components, or to gain added freedom in blind connection of any cable/connector designs.

A method comprising one of the following steps is an example of the invention: snapping capture parts together to encapsulate a floating connector, supporting and securing the floating connector within a capture portion, sliding the capture portion onto a base housing portion, providing a cavity in the base housing portion to fit a sliding portion of the capture portion, providing zones of tolerance for lateral planar movements as well as rotational movements about two axes for the encapsulated floating connector, sliding a can portion onto a base portion, contacting a mating connector with a floating connector, pushing the floating connector onto position of alignment with the mating connector for contact, using the apparatus or system mentioned above, for purpose of invitation or blind-mating a floating connector.

Any variation of the above teaching is also intended to be covered by this patent application.

The invention claimed is:

1. An apparatus for blind-mating a floating connector with a mating connector within a printer system, said apparatus comprising:

a connector capture portion; and a base housing receptacle;

wherein said floating connector is attached to a flex cable;

wherein said floating connector has a connector protrusion and a first contacting face;

wherein said flex cable is attached to a base portion of said printer system;

wherein said mating connector is attached to a can portion of said printer system;

wherein said mating connector has a second contacting face;

wherein said blind-mating is done by sliding said can portion of said printer system onto said base portion of said printer system so that said second contacting face of said mating connector contacts said first contacting face of said floating connector;

wherein said connector capture portion comprises of a first capture part and a second capture part;

wherein said first capture part comprises:

a front lead-in alignment guide, a first back support portion having a back support groove, a first plurality of sides, wherein each of said first plurality of sides has a side groove, and a first sliding snap;

wherein said first capture part has a first cable gap between said first back support portion and said first plurality of sides;

wherein said first capture part has a connector gap between said front lead-in alignment guide and said first plurality of sides;

wherein said second capture part comprises:

a second back support portion having a back support snap, a second plurality of sides, wherein each of said second plurality of sides has a side snap, and a second sliding snap;

wherein said second capture part has a second cable gap between said second back support portion and said second plurality of sides;

wherein said first capture part and said second capture part snap together to encapsulate said floating connector;

wherein in said encapsulation, said back support snap fit in said back support groove, each said side snap of each of said second plurality of sides fits in corresponding said side groove of corresponding one of said first plurality of sides, said first cable gap and said second cable gap align to fit said flex cable through said connector capture portion, said first back support portion and said second back support portion align to support said floating connector within said connector capture portion, said connector protrusion fit in said connector gap through said connector capture portion, said front lead-in alignment guide aligns above and beyond said first contacting face of said floating connector, exposing said first contacting face through said connector capture portion, and said connector capture portion securely encapsulates said floating connector;

wherein said base housing receptacle is attached to said base portion of said printer system;

wherein said base housing receptacle comprises:

a rib, a first base mating element, and a second base mating element;

wherein said rib is positioned between said first base mating element and said second based mating element so to provide a cavity within said base housing receptacle;

wherein a sliding portion of said connector capture portion comprises: a first front portion of said first back support portion, a second front portion of said second back support portion, said first sliding snap, and said second sliding snap;

wherein dimensions of said cavity are larger than corresponding dimensions of said sliding portion so that said sliding portion loosely fits within said cavity by sliding said connector capture portion onto said base housing receptacle along said rib;

wherein said first back support portion and said second back support portion are located above said rib, said first sliding snap fits in said first base mating element, and said second sliding snap fits in said second base mating element, to hold said sliding portion within said cavity of said base housing receptacle;

wherein at said blind-mating, said base housing receptacle provides a rotational tolerance zone for said connector capture portion within said cavity by having said connector capture portion pivot along and over said rib so that said first contacting face becomes parallel to said second contacting face;

wherein at said blind-mating, said base housing receptacle provides a planar tolerance zone within said cavity for both lateral movements and rotation of said connector capture portion within a plane parallel to said second contacting face; and wherein at said blind-mating, if said first contacting face and said second contacting face are misaligned prior to said blind-mating, then said front lead-in alignment guide is moved by said mating connector to position said connector capture portion within said rotational tolerance zone and said planar tolerance zone so that said first contacting face and said second contacting face come to alignment for contact while said sliding portion of said connector capture portion is held within said base housing receptacle.

* * * * *